US010038251B2

(12) United States Patent
Wong et al.

(10) Patent No.: US 10,038,251 B2
(45) Date of Patent: Jul. 31, 2018

(54) TRACKING ANTENNA SYSTEM HAVING MULTIBAND SELECTABLE FEED

(71) Applicant: SEA TEL, INC., Concord, CA (US)

(72) Inventors: Larry Wong, Berkeley, CA (US); Wei-jung Guan, Walnut Creek, CA (US); Glafkos Yianni Philippou, Leatherhead (GB); Peter Blaney, Walnut Creek, CA (US)

(73) Assignee: Sea Tel, Inc, Concord, CA (US)

( * ) Notice: Subject to any disclaimer, the term of this patent is extended or adjusted under 35 U.S.C. 154(b) by 0 days.

(21) Appl. No.: 15/114,769

(22) PCT Filed: Jan. 28, 2015

(86) PCT No.: PCT/US2015/013332

§ 371 (c)(1),
(2) Date: Jul. 27, 2016

(87) PCT Pub. No.: WO2015/116705

PCT Pub. Date: Aug. 6, 2015

(65) Prior Publication Data

US 2016/0344107 A1 Nov. 24, 2016

Related U.S. Application Data

(60) Provisional application No. 61/932,508, filed on Jan. 28, 2014.

(51) Int. Cl.
*H01Q 19/19* (2006.01)
*H01Q 1/34* (2006.01)
(Continued)

(52) U.S. Cl.
CPC ..... *H01Q 19/192* (2013.01); *H01Q 1/34* (2013.01); *H01Q 3/20* (2013.01); *H01Q 5/45* (2015.01);
(Continued)

(58) Field of Classification Search
CPC ..... H01Q 15/16; H01Q 19/132; H01Q 19/17; H01Q 19/192; H01Q 1/34; H01Q 25/007;
(Continued)

(56) References Cited

U.S. PATENT DOCUMENTS 3,005,987 A 10/1961 Mack et al.
4,464,666 A * 8/1984 Watanabe ..... H01Q 19/192 343/761

(Continued)

FOREIGN PATENT DOCUMENTS

WO WO2011/014919 A1 2/2011

OTHER PUBLICATIONS

Comtech, "Comtech EF Data Completes Interoperability Testing with Cobham SATCOM to Enhance Maritime Connectivity," Article, Oct. 2, 2013, retrieved on Mar. 4, 2015 from the internet, <URL:http:www.comtechefdata.com/about/mediacenter/news-releases/pressroom/news-release-october-2-2013>, pgs.

(Continued)

*Primary Examiner* — Tho G Phan
(74) *Attorney, Agent, or Firm* — Morgan, Lewis & Bockius LLP

(57) ABSTRACT

A tracking antenna system for use in a plurality of discrete radio frequency (RF) spectrums includes a stabilized antenna support configured to direct and maintain the antenna in alignment with a communications satellite; a reflector mounted on the stabilized antenna support, the reflector reflecting radio waves along a first RF path; a first feed for gathering radio waves within a first of the discrete RF spectrums traveling from the reflector; a sub-reflector movable between first and second positions, the first position outside the first RF path and the second position in the first RF path to redirect radio waves traveling from the reflector along the first RF path to a second RF path; a second feed for gathering radio waves within a second of the discrete RF spectrums redirected along the second RF path;
(Continued)

and an actuator for moving the sub-reflector between the first and second positions.

12 Claims, 12 Drawing Sheets

(51) Int. Cl.

| | |
|---|---|
| ***H01Q 3/20*** | (2006.01) |
| ***H01Q 19/13*** | (2006.01) |
| ***H01Q 19/17*** | (2006.01) |
| ***H01Q 25/00*** | (2006.01) |
| ***H01Q 5/45*** | (2015.01) |
| ***H01Q 15/16*** | (2006.01) |
| *H01Q 3/02* | (2006.01) |

(52) U.S. Cl.
CPC ..... *H01Q 15/16* (2013.01); *H01Q 19/132* (2013.01); *H01Q 19/17* (2013.01); *H01Q 25/007* (2013.01); *H01Q 3/02* (2013.01)

(58) Field of Classification Search
CPC ..... H01Q 3/20; H01Q 5/45; H01Q 13/02; H01Q 15/14
See application file for complete search history.

(56) References Cited

U.S. PATENT DOCUMENTS

| | | | | |
|---|---|---|---|---|
| 5,351,060 | A * | 9/1994 | Bayne | H01Q 1/1257 342/359 |
| 5,485,168 | A | 1/1996 | Parekh | |
| 5,673,057 | A | 9/1997 | Toland et al. | |
| 6,266,027 | B1 | 7/2001 | Neel | |
| 6,441,794 | B1 | 8/2002 | Minh et al. | |
| 6,512,486 | B1 * | 1/2003 | Desargant | G01S 3/325 343/700 MS |
| 9,281,561 | B2 * | 3/2016 | Monte | H01Q 3/18 |
| 9,647,334 | B2 * | 5/2017 | Lanciault | H01Q 3/20 |
| 2003/0169490 | A1 | 9/2003 | Hwang et al. | |
| 2005/0057433 | A1 | 3/2005 | Kaufman et al. | |
| 2011/0012801 | A1 | 1/2011 | Monte et al. | |
| 2012/0280044 | A1 | 11/2012 | Mullis et al. | |

OTHER PUBLICATIONS

Sea Tel, Inc., International Search Report and Written Opinion, PCT/US2015/013332, dated May 6, 2015, 8 pgs.

Sea Tel, Inc., International Preliminary Report on Patentability, PCT/US2015/013332, dated Aug. 2, 2016, 6 pgs.

Sea Tel, Inc., Communication Pursuant to Rules 161(2) and 162, EP15743468.9, dated Sep. 16, 2016, 2 pgs.

Sea Tel Inc., "Operation Manual for Sea Tel Media Xchange Point (MXP) with Broadband-At-Sea Transmit / Receive Systems," Sea Tel Cobham—Operat ion Manuals, Dec. 11, 2012, from http://www/livewire-connections.com/sites/default/files/files/documents/138209_A2_Operation%20Manual_MXP.pdf, 54 pgs.

Sea Tel, Inc., European Search Report, EP15743468.9, dated Sep. 8, 2017, 9 pgs.

* cited by examiner

TRACKING ANTENNA SYSTEM HAVING MULTIBAND SELECTABLE FEED

CROSS-REFERENCES TO RELATED APPLICATIONS

This Application is a United States National Stage Application filed under 35 U.S.C. § 371 of PCT Patent Application Serial No. PCT/US2015/013332 filed on Jan. 28, 2015, which claims the benefit of and priority to U.S. Provisional Patent Application No. 61/932,508 filed on Jan. 28, 2014 entitled TRACKING ANTENNA SYSTEM HAVING MULTIBAND SELECTABLE FEED, which is hereby incorporated by reference in its entirety.

BACKGROUND OF INVENTION

Field of Invention

This application relates, in general, to tracking antenna systems, and more particularly to such systems having multiband selectable feeds, and methods for their use.

Description of Related Art

Tracking antenna systems are especially suitable for use aboard ships to track communications satellites while accommodating for roll, pitch, yaw, and turning motions of a ship at sea. For such systems to operate effectively they must point one or more antenna continuously and accurately in the direction toward a respective satellite.

For nearly two decades, Sea Tel, Inc. has manufactured antenna systems of the type described in U.S. Pat. No. 5,419,521 to Matthews. Such antenna systems have a three-axis pedestal and employ a "Level Platform" or "Level Cage" in order to provide an accurate and stable Horizontal reference for directing servo stabilized antenna controls to accurately track communications satellites.

Tracking antenna systems are especially well suited for the reception of satellite television signals, which are typically in the C-band (4-8 GHz) or the Ku-band (12-18 GHz), each band having its relative strengths and weaknesses. For example, C-band signals are susceptible to terrestrial interference, while Ku-band signals are affected by rain and ice crystals. Accordingly, it is desirable for an antenna system to be configured for receiving both C-band and Ku-band signals.

One such system is described in U.S. Patent Application Publication No. 2012/0001816, which describes various systems which include a large primary reflector for C-band satellites and a smaller secondary reflector for Ku-band satellites (see, e.g., '816 publication, FIGS. 15 and 16). Such systems are switchable such that, the primary reflector is aligned with and tracks a C-band satellite in C-band mode, and the secondary reflector is aligned with and tracks a Ku-band satellite in Ku-band.

While such systems are compatible with known and planned satellite television networks, one will appreciate that an antenna system having a single reflector that is configured to receive both C-band and Ku-band signals would be desirable.

BRIEF SUMMARY

One aspect of the present invention is directed to a tracking antenna system for use in a plurality of discrete radio frequency (RF) spectrums including a stabilized antenna support, a reflector mounted on the stabilized antenna support for tracking satellites, the reflector reflecting radio waves along a first RF path to a primary focal point, a first feed for gathering radio waves within a first of the discrete RF spectrums traveling from the reflector, the first feed being disposed in front of the reflector adjacent the primary focal point, a sub-reflector movable between first and second positions, the first position being outside of the first RF path, and the second position being in the first RF path to redirect radio waves traveling from the reflector along the first RF path to a second RF path, a second feed for gathering radio waves within a second of the discrete RF spectrums traveling from the reflector and redirected by the sub-reflector along the second RF path, the second feed being disposed outside of the first RF path, and an actuator for moving the sub-reflector between the first and second positions.

The reflector may be a parabolic reflector and the sub-reflector is a convex hyperboloid reflector.

The reflector may be asymmetric, and the sub-reflector may be positioned to not obstruct radio waves received by the reflector.

The first feed may be disposed in front of the reflector adjacent the primary focal point The first feed may be mounted to the reflector by a first feed support. The first feed may be affixed with respect to the reflector and the stabilized antenna support. The first and second feeds may be affixed with respect to the reflector and the stabilized antenna support.

The second feed may be affixed with respect to the reflector and the stabilized antenna support. The second feed is may be mounted to the reflector by a second feed support.

The first of the discrete RF spectrums may be a C band.

The second of the discrete RF spectrums may be a Ku band.

The actuator may include a rotation mechanism including first and second mechanical stops and first and second limit switches to locate the position of the sub-reflector in the respective first and second positions.

The first feed may be operably connected to a first RF module and the second feed may be operably connected to a second RF module, each of the first and second RF modules may be configured for use with a first Media Exchange Points (MXP) connected to a digital antenna control unit (DAC).

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Generally, the tracking antenna system of the present invention is configured to access multiple frequency bands, for example, to switch between C-band and Ku-band frequencies. One will appreciate that the multiple frequency bands may include other satellite frequencies. In accordance with the present invention, the tracking antenna system includes primary and secondary band feeds that are stationary with respect to a reflector, and further includes a sub-reflector that moves between two positions. In the first position, the sub-reflector is out of the RF path between the reflector and the primary band feed. In the second position, the sub-reflector redirects RF signals from the primary reflector to the secondary band feed.

The tracking antenna system of the present invention generally includes supporting structural members, bearings, drive means, and etc. for positioning and stabilizing the reflector to track satellites in an otherwise conventional manner. In some aspects, the tracking antenna system of the present invention is similar to those disclosed by U.S. Pat. No. 5,419,521 entitled THREE-AXIS PEDESTAL, U.S. Pat. No. 8,542,156 entitled PEDESTAL FOR TRACKING ANTENNA, U.S. Patent Application Publication No. 2010-0295749 entitled RADOME FOR TRACKING ANTENNA, and U.S. Patent Application Publication No. 2012-0001816 entitled THREE-AXIS PEDESTAL HAVING MOTION PLATFORM AND PIGGY BACK ASSEMBLIES, the entire content of which patents and publications is incorporated herein for all purposes by this reference, as well as those used in the Sea Tel® 9707, 9711 and 9797 VSAT systems, as well as other satellite communications antennas sold by Cobham SATCOM of Concord, Calif.

Figure 1A:
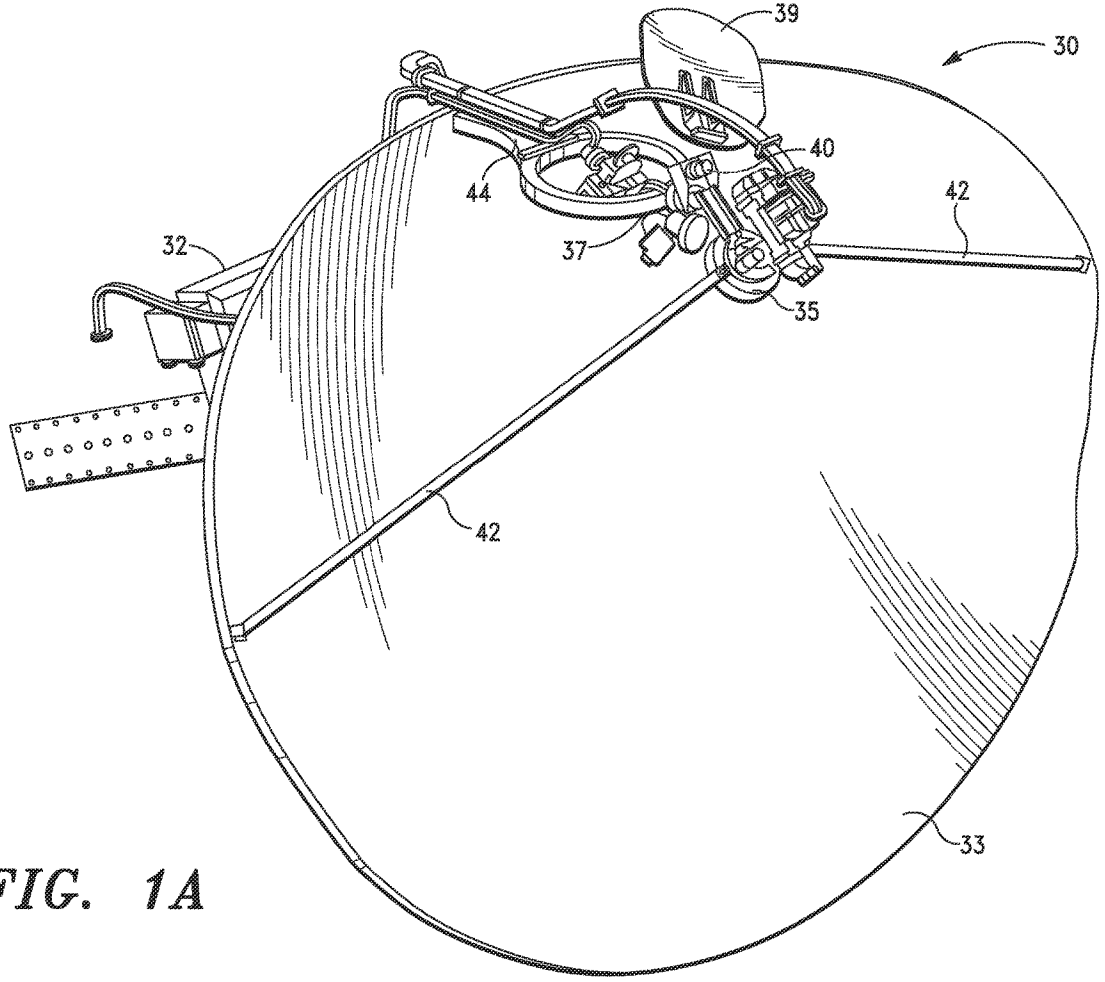
FIG. 1A and FIG. 1B are isometric views of a tracking antenna system having a multiband selectable feed in accordance with the present invention, in respective C-band and Ku-band operational modes.
Figure 1B:
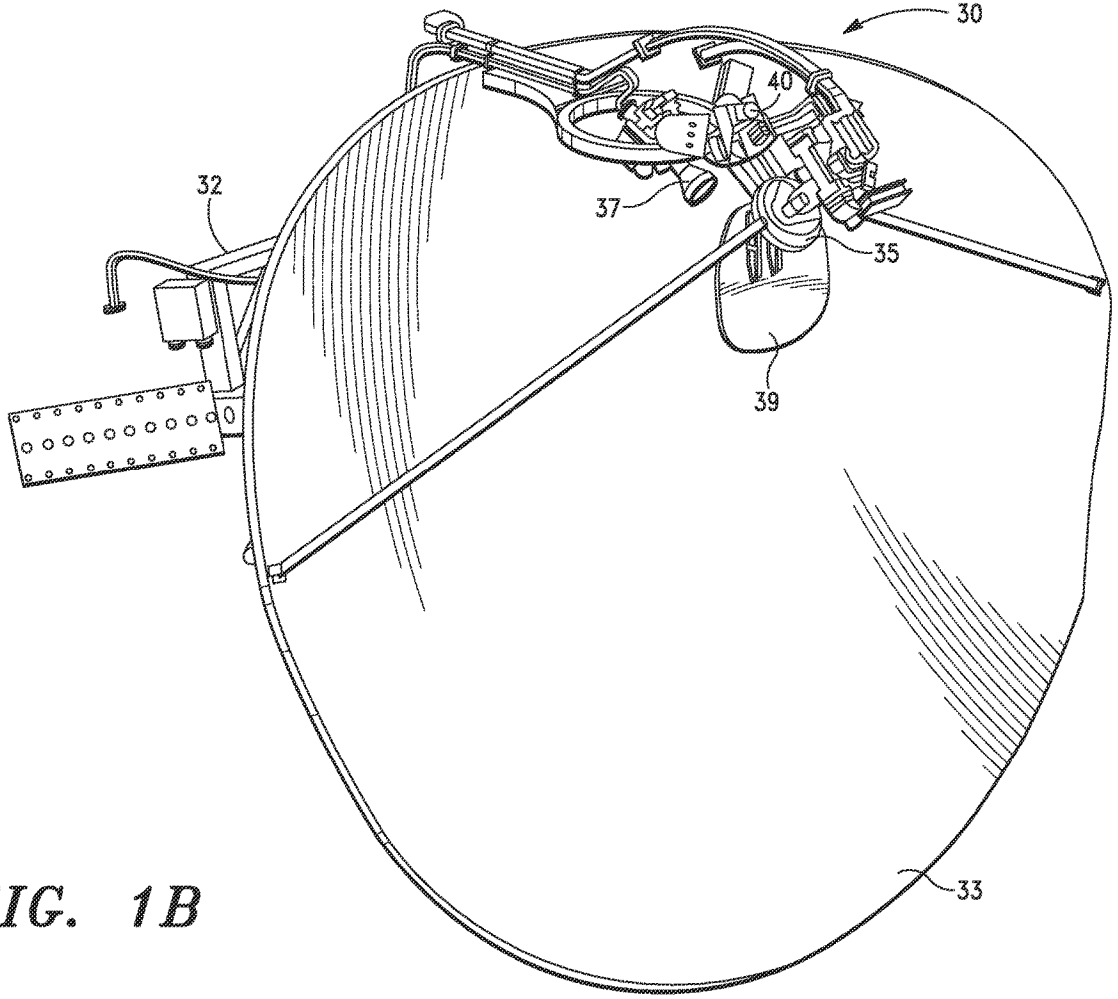
Figure 2A:
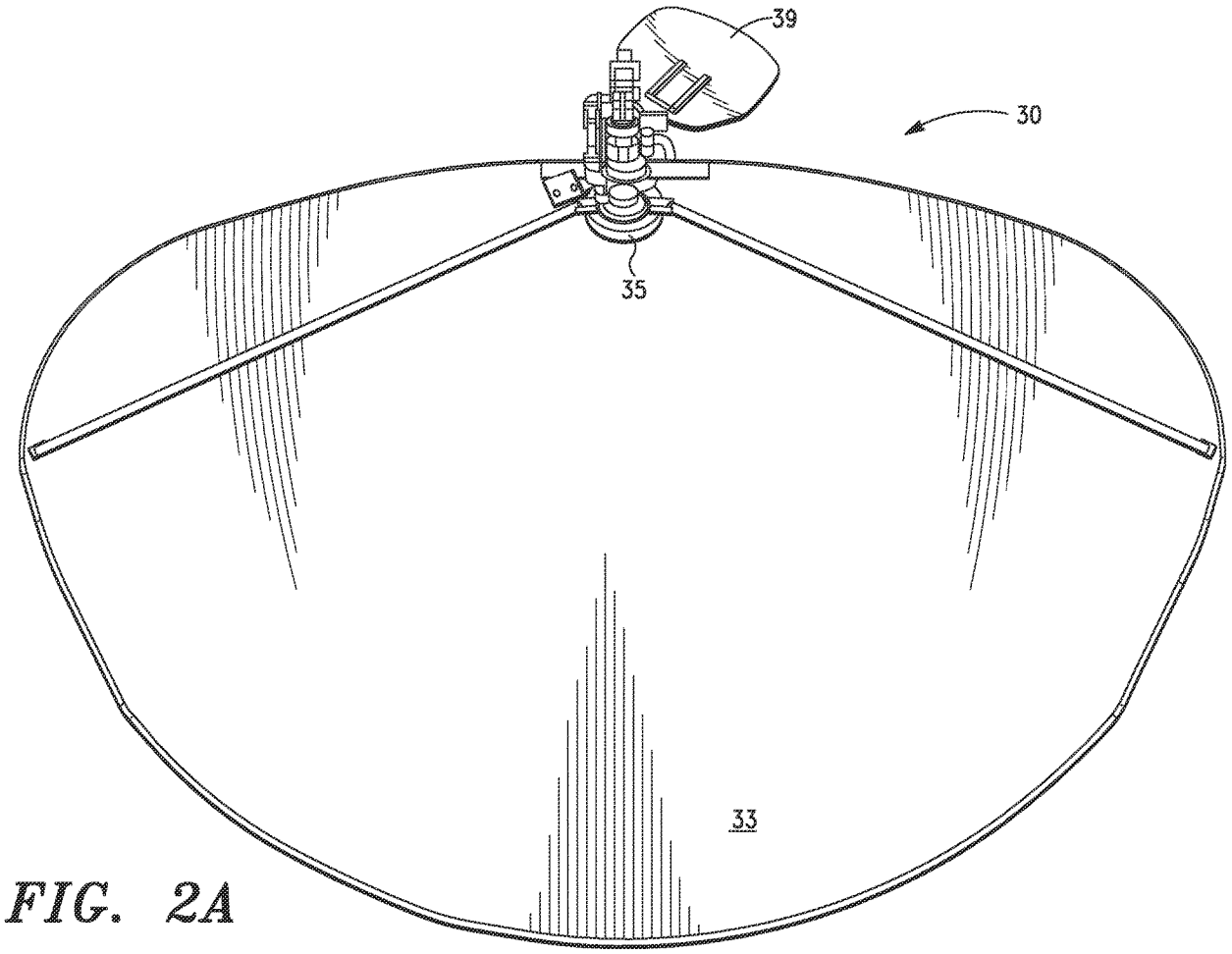
FIG. 2A and FIG. 2B are front views of the tracking antenna system of FIG. 1A, in respective C-band and Ku-band operational modes.
Figure 2B:
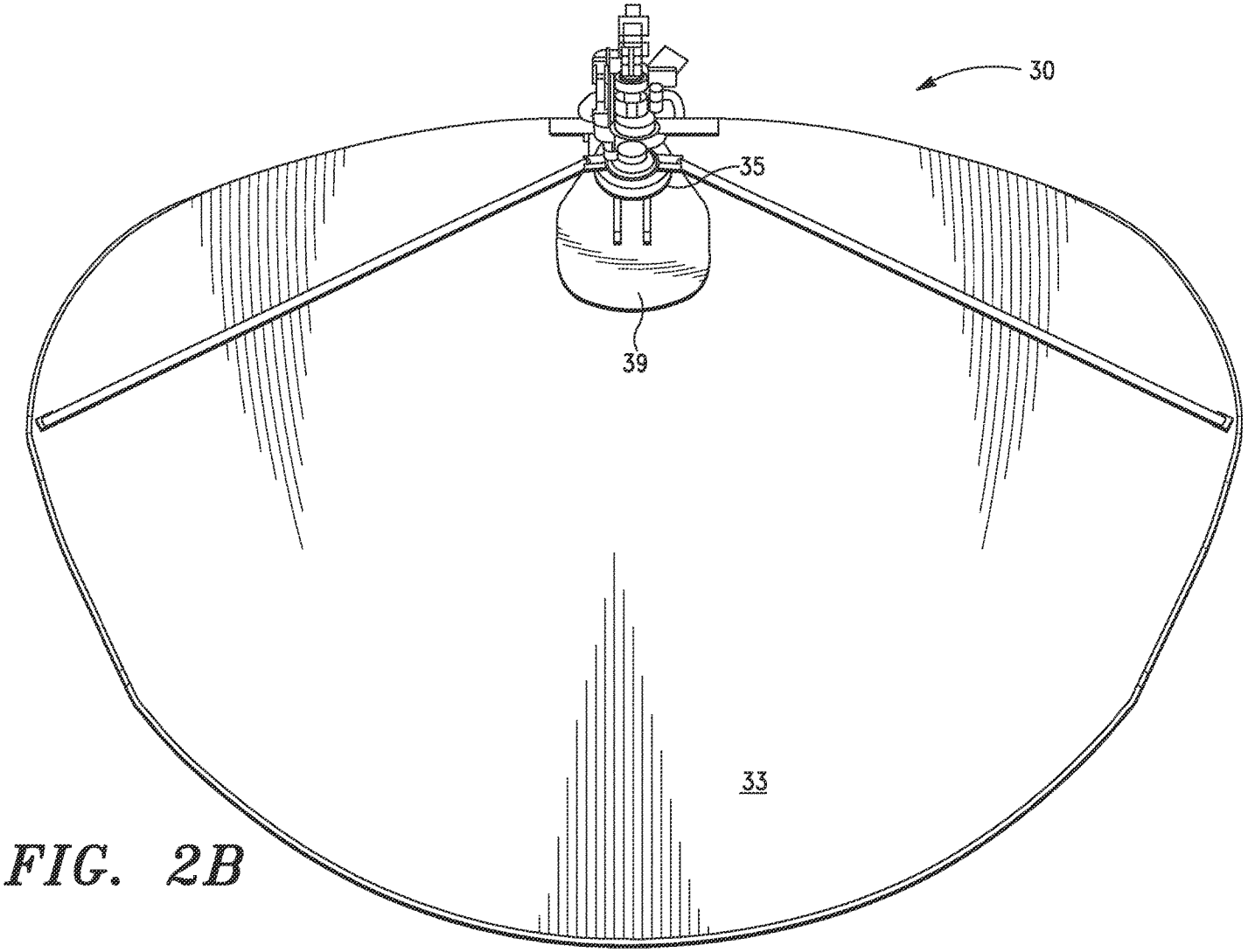

Turning now to the drawings, wherein like components are designated by like reference numerals throughout the various figures, attention is directed to FIG. 1A and FIG. 1B, which shows a tracking antenna system, generally designated by the numeral 30, for use in a plurality of discrete radio frequency (RF) spectrums. The antenna system generally includes a stabilized antenna support 32, a reflector 33, a first feed 35 a second feed 37, a sub-reflector 39 movable between first and second positions, and an actuator 40 for moving the sub-reflector between the first and second positions.

Reflector 33 is mounted on the stabilized antenna support for tracking satellites in an otherwise conventional manner. Similar to the stabilized antenna support described in the above-mentioned '521 and 156 patents, and the above-mentioned '749 and '816 publications, stabilized antenna support 32 is configured to accurately direct and maintain reflector 33 in proper alignment with a communications satellite, for example, adjusting the reflector about azimuth, cross-level and elevation axes. In the illustrated embodiment, the reflector is a parabolic reflector that is configured to reflect radio waves along a first RF path to a primary focal point, at which first feed 35 is positioned to gather radio waves within a first of the discrete RF spectrums traveling from the reflector. In the illustrated embodiment, the first feed is stationary with respect to the reflector, however, one will appreciate that other suitable configurations may be used. The reflector and first feed thus function as an off-axis or offset front feed antenna.

The first feed is mounted stationary with respect to the reflector by a first feed support 42. For example, the first feed support may simply include struts that position the first feed with respect to the reflector. Again, one will appreciate that various support structures and means may be utilized to properly position the first feed with respect to the reflector.

The first feed is operably connected to an RF module that is configured for use with Media Exchange Points (MXP) and a digital antenna control unit (DAC) in an otherwise conventional manner.

In the illustrated embodiment, actuator 40 is stationary with respect to the reflector, however, one will appreciate that other suitable configurations may be used. The actuator movably supports sub-reflector 39 to move between first and second positions. In the first position, shown in FIG. 1A, the sub-reflector is located outside of the first RF path such that radio waves reflected by the reflector pass uninterrupted along the first RF path to first feed 35. In the second position, shown in FIG. 1B, the sub-reflector is located in the first RF path and is configured to redirect radio waves traveling from the reflector along the first RF path to a second RF path. In the illustrated embodiment, the sub-reflector is a convex hyperboloidal reflector, however, one will appreciate that other suitable configurations may be used.

Figure 3A:
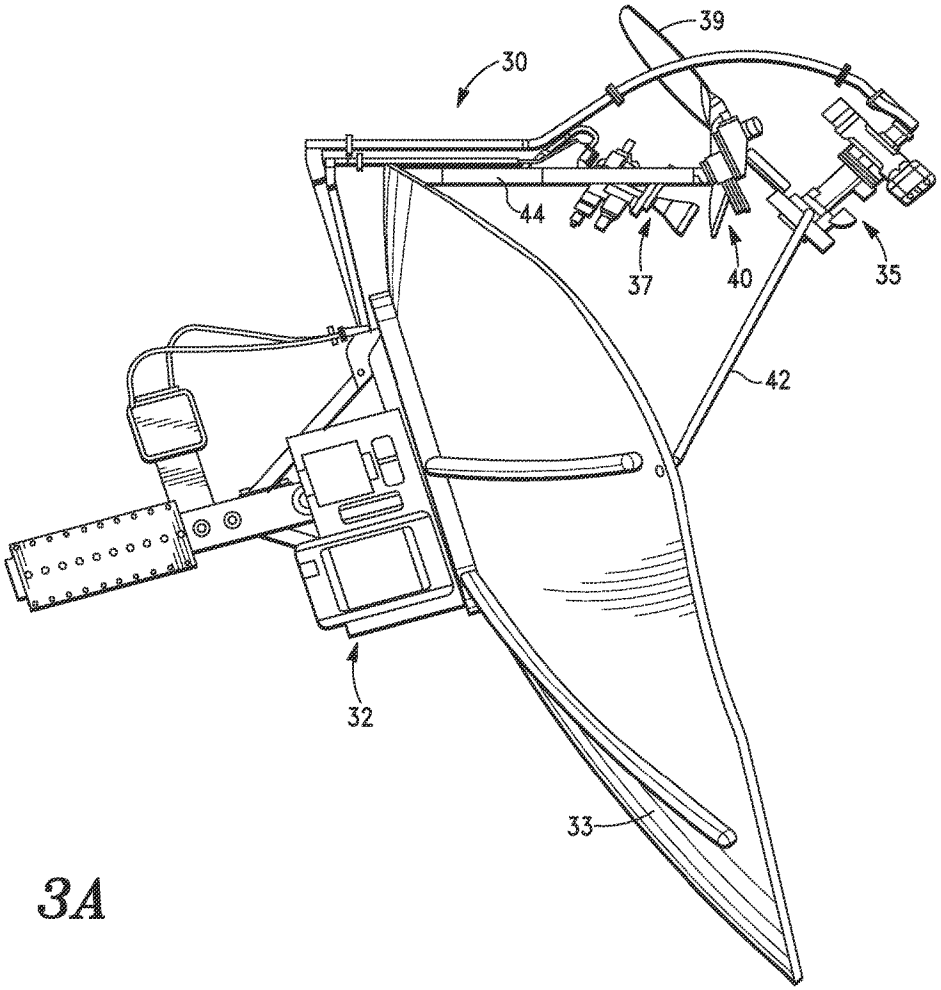
FIG. 3A and FIG. 3B are elevational views of the tracking antenna system of FIG. 1A, in respective C-band and Ku-band operational modes.
Figure 3B:
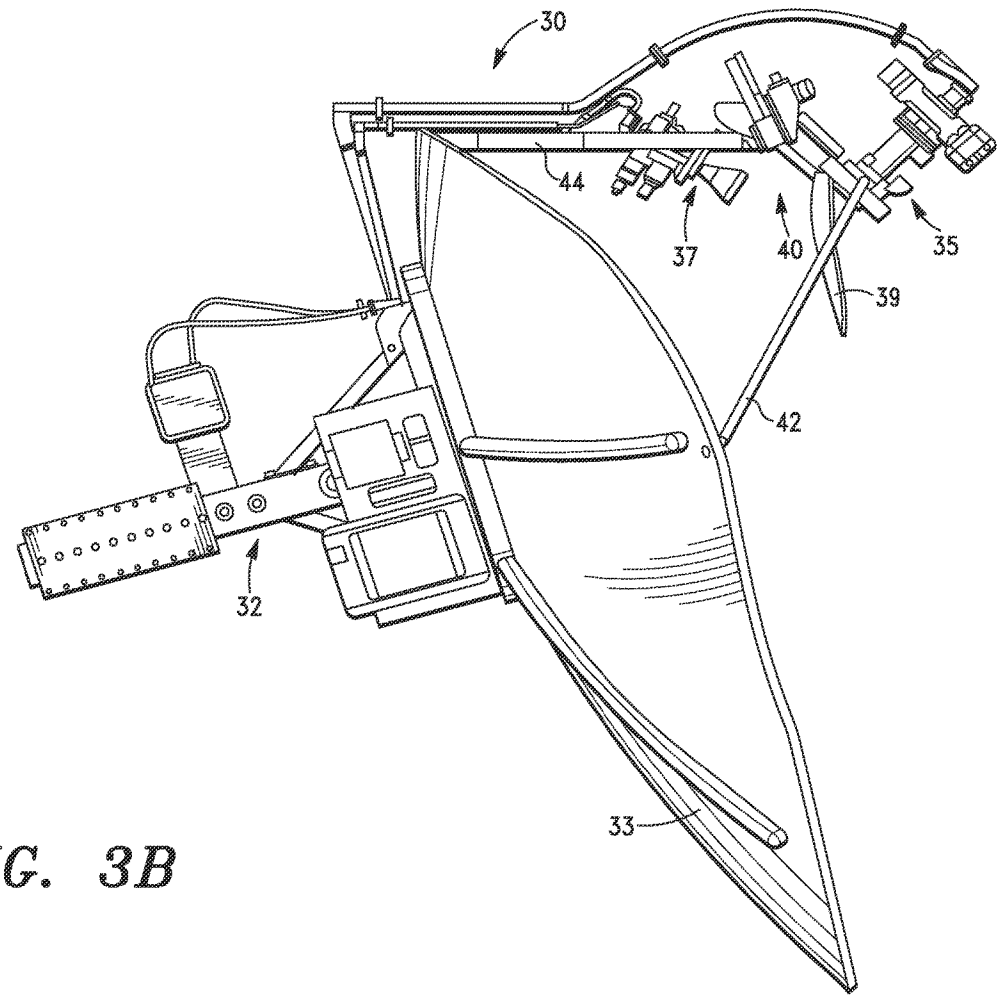
Figure 4A:
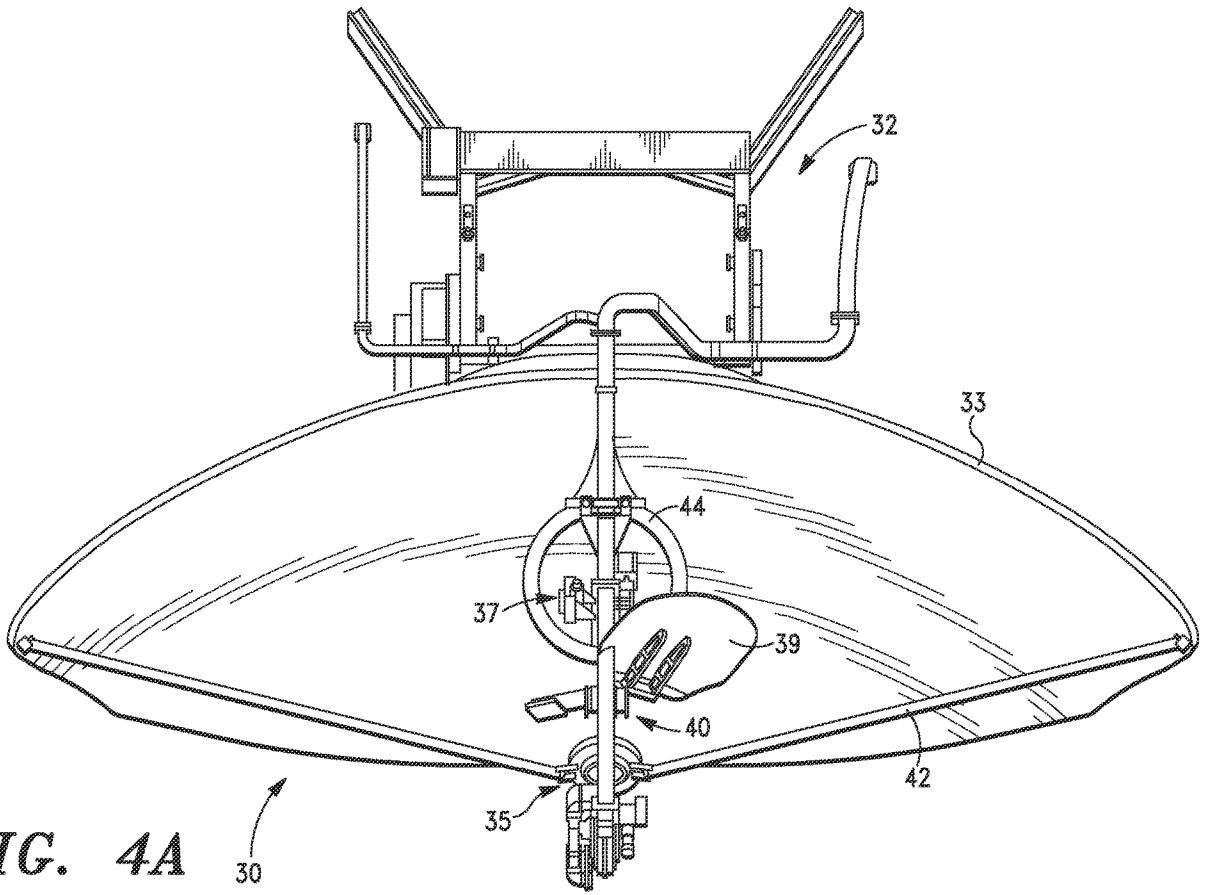
FIG. 4A and FIG. 4B are top views of the tracking antenna system of FIG. 1A, in respective C-band and Ku-band operational modes.
Figure 4B:
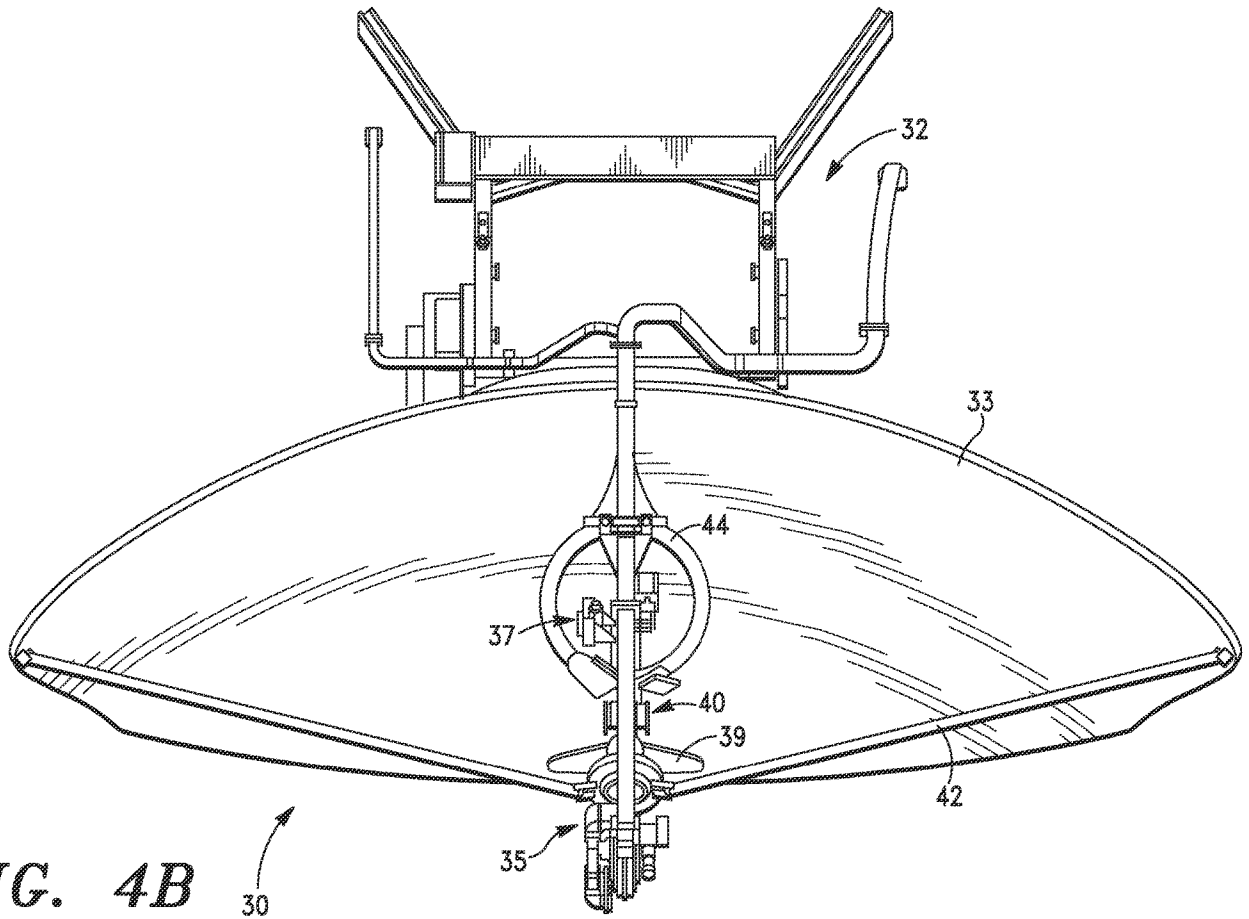

Second feed 37 is also stationary with respect to the reflector, however, one will appreciate that other suitable configurations may be used. The second feed is positioned for gathering radio waves within a second of the discrete RF spectrums traveling from the reflector and redirected by the sub-reflector along the second RF path. As can be seen in FIG. 3A and FIG. 3B, the second feed being disposed outside of the first RF path.

Figure 5:
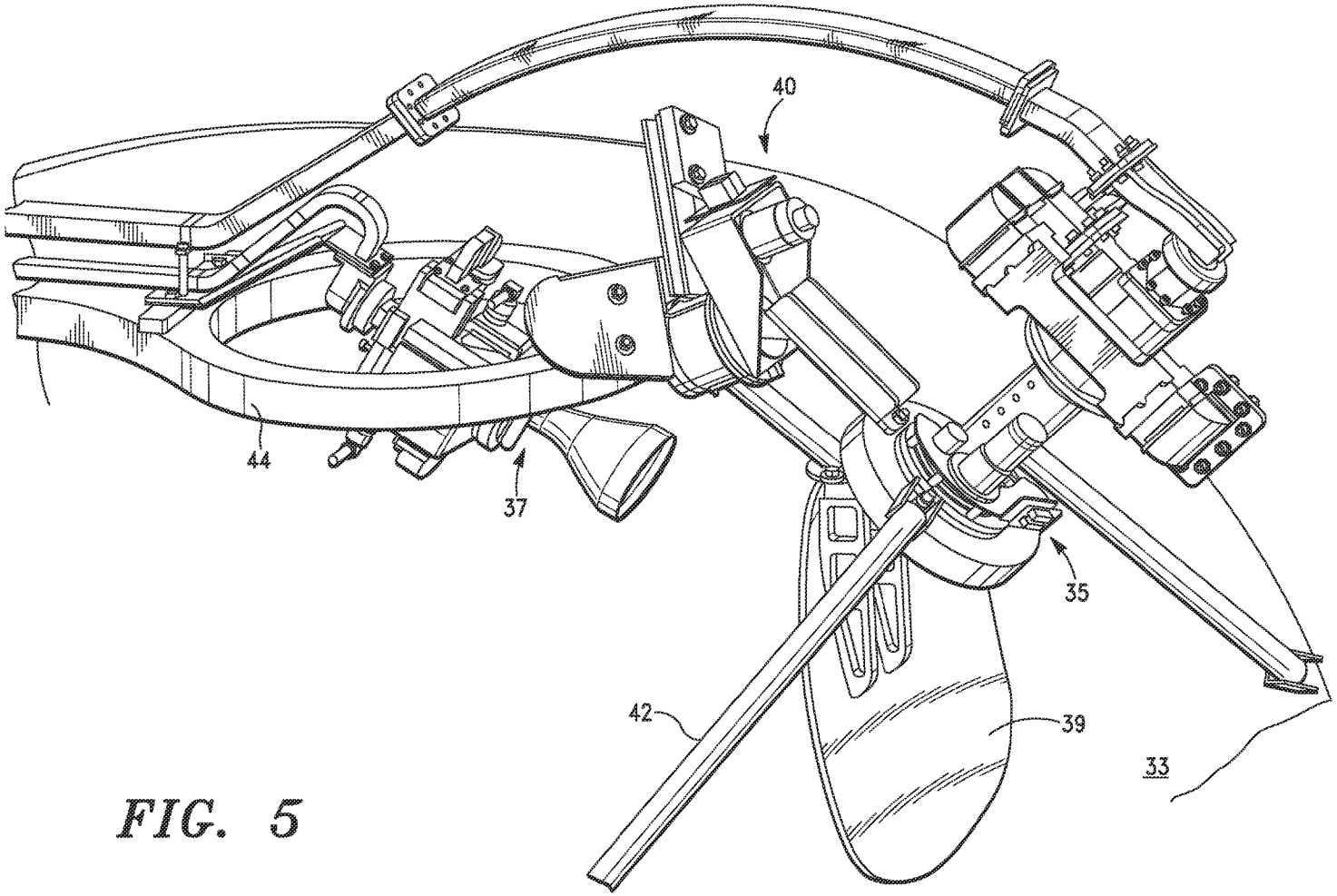
FIG. 5 is an enlarged isometric views of an actuator of the tracking antenna system of FIG. 1A, in a Ku-band operational mode.

The second feed may also be mounted stationary with respect to the reflector by a second feed support 44. As shown in FIG. 5, the second feed support may include a yoke that rigidly positions second feed 37 with respect to reflector 33. Again, one will appreciate that various support structures and means may be utilized to properly position the second feed with respect to the reflector.

The second feed is also operably connected to an RF module that is configured for use with Media Exchange Points (MXP) and a digital antenna control unit (DAC) in an otherwise conventional manner.

Figure 6:
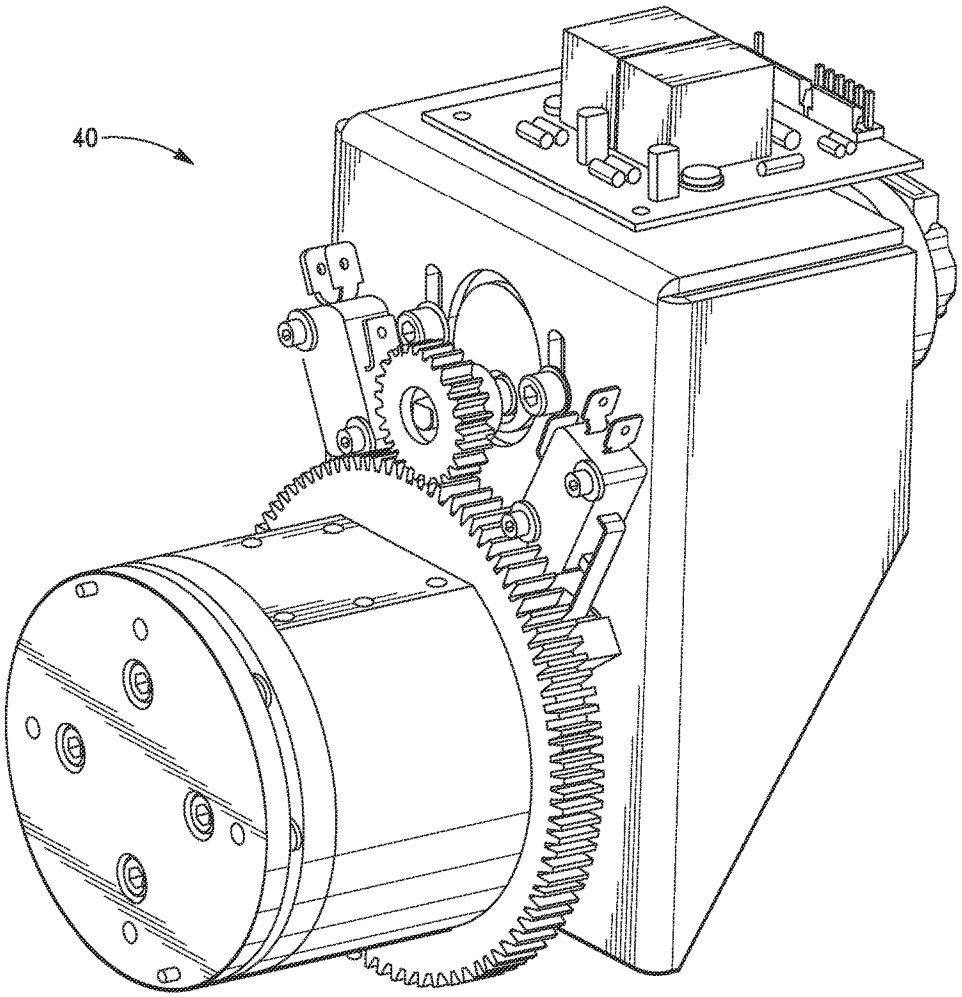
FIG. 6 is an isometric view of the actuator of FIG. 5.
Figure 7B:
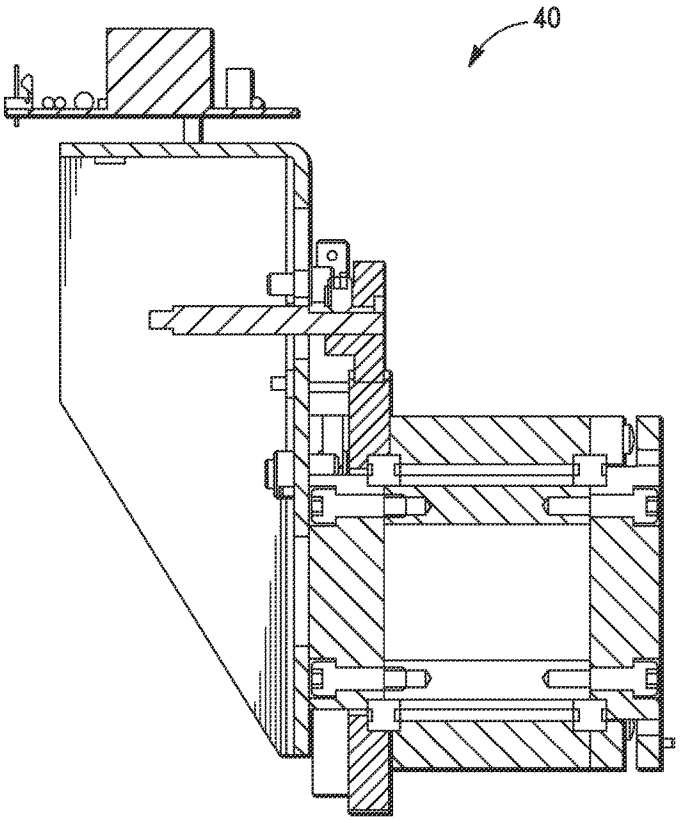
FIG. 7A and FIG. 7B are front plan and side cross-sectional views of the actuator of FIG. 5, FIG. 7B being a cross-section taken along line A-A of FIG. 7A.
Figure 7A:
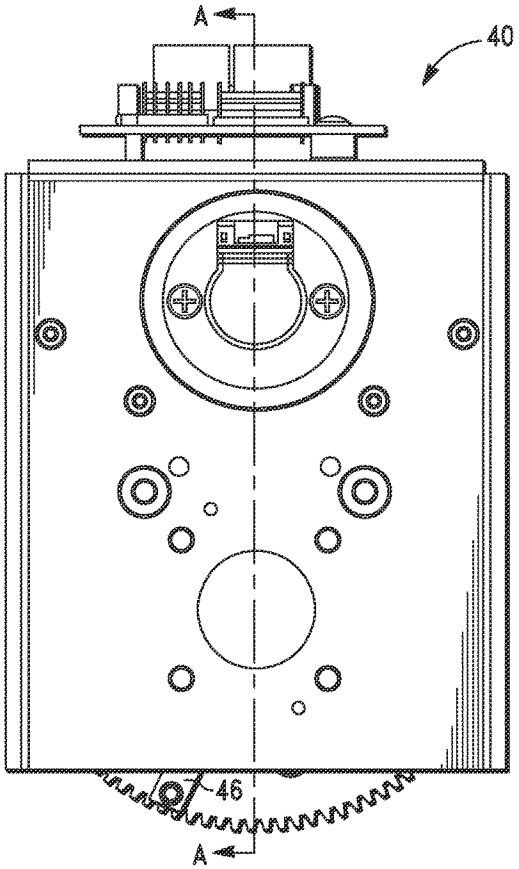
Figure 8B:
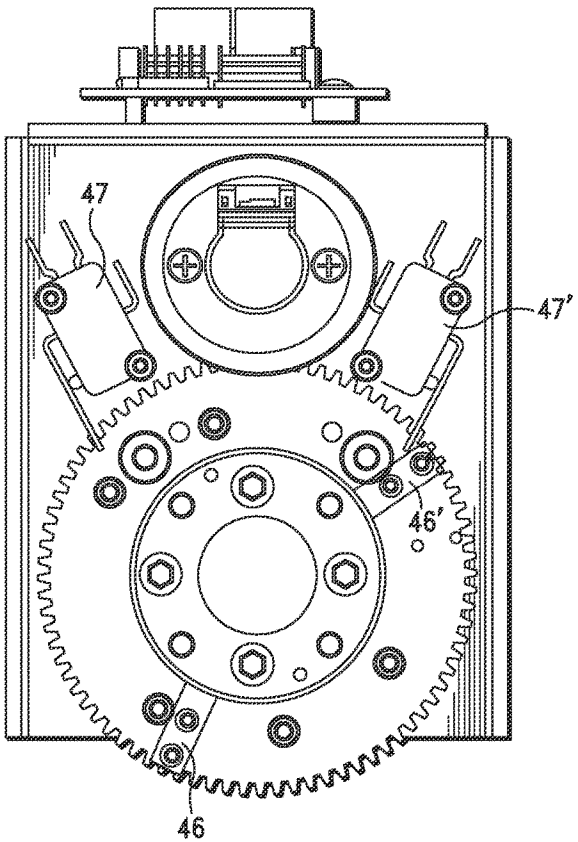
FIG. 8A and FIG. 8B are schematic front views of the actuator of FIG. 5, in respective C-band and Ku-band operational modes.
Figure 8A:
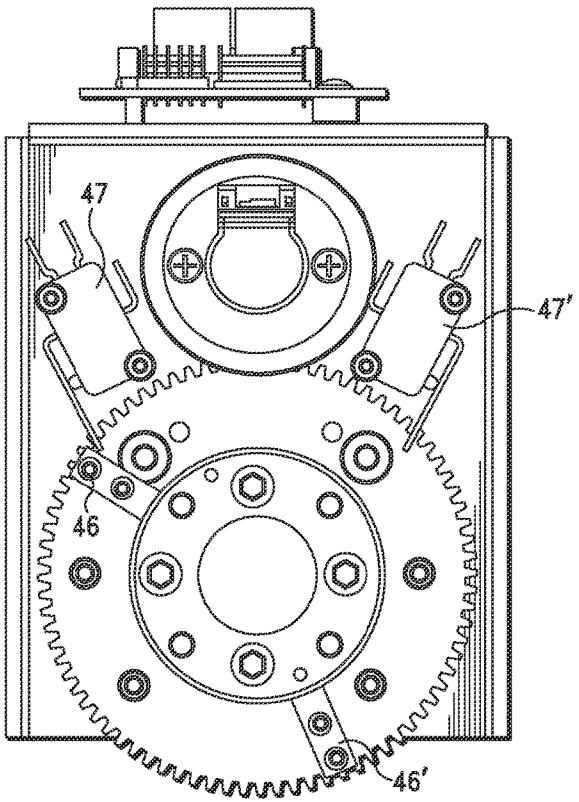

In the illustrated embodiment, and as shown in FIG. 5 and FIG. 6, actuator 40 is a rotation mechanism that swings sub-reflector between the first position shown in FIG. 3A and the second position shown in FIG. 3B. In the illustrated embodiment, the actuator includes an electric motor and gear assembly to effect movement between the first and second positions. The actuator includes first and second mechanical stops 46, 46' and first and second limit switches 47, 47' to locate the position of the sub-reflector in the respective first and second positions.

In operation and use, stabilized antenna system 30 of the present invention has the ability to access both C-band and Ku-band frequencies with a single antenna, and namely with a single primary reflector 33. As noted above, the C-band and Ku-band feeds are stationary (e.g., first and second feeds, 35 and 37, respectively) while sub-reflector rotates 39 in and out of the RF path of the main reflector 33. The focal point of sub-reflector 39 is preferable the same as that of reflector 33. Under C-band operation, the Ku-band sub-reflector 39 rotates out of the RF path so the signal hits the main reflector 33 and is channeled to the focal point at the C-band feed 35. Under Ku band operation, the Ku sub-reflector 39 rotates into the RF path so the signal hits the main reflector 33 and is channeled towards the focal point, where the Ku sub-reflector 39 redirects the signal to the Ku band feed 37.

Actuator 40 contains two mechanical stops 46, 46' and two limit switches 47, 47' to position and locate the position of the Ku sub-reflector 39, respectively. Under C band operation, the Ku sub-reflector is driven in one direction with a constant voltage until a limit switch is triggered. Once a limit switch is triggered, the voltage is reduced, which reduces the speed of the motor and hits the respective mechanical stop. The reduced voltage is applied to ensure the mechanical stop is engaged, which accurately locates the Ku sub-reflector. The limit switch is engaged so the position of the Ku sub-reflector is known. Under Ku-band operation, the Ku sub-reflector is driven the other direction with a constant voltage until the other limit switch is triggered. Once the limit switch is triggered, the voltage is reduced, which reduces the speed and hits the other respective mechanical stop. The reduced voltage is applied to ensure the mechanical stop is engaged, which again locates the Ku sub-reflector in the respective position. The limit switch is engaged so the position of the Ku sub-reflector is known.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A tracking antenna system for use in a plurality of discrete radio frequency (RF) spectrums, the antenna system comprising:

a stabilized antenna support configured to direct and maintain the antenna system in alignment with a communications satellite;

a reflector mounted on the stabilized antenna support for tracking satellites, the reflector reflecting radio waves along a first RF path to a primary focal point;

a first feed for receiving radio waves within a first of the discrete RF spectrums traveling from the reflector adjacent the primary focal point, wherein at least one elongate first feed support is directly coupled between the first feed and the reflector;

a sub-reflector movable between first and second positions, the first position being outside of the first RF path such that the subreflector does not redirect the radio waves reflected by the reflector, and the second position being in the first RF path to redirect radio waves traveling from the reflector along the first RF path to a second RF path;

a second feed for receiving waves within a second of the discrete RF spectrums traveling from the reflector and redirected by the sub-reflector along the second RF path, wherein a second feed support that is distinct from the at least one elongate first feed support is directly coupled between the second feed and the reflector; and an actuator for moving the sub-reflector between the first and second positions.

2. The tracking antenna system of claim 1, wherein the reflector is a parabolic reflector and the sub-reflector is a convex hyperboloid reflector.

3. The tracking antenna system of claim 1, wherein the reflector is asymmetric, and wherein the sub-reflector does not obstruct radio waves received by the reflector.

4. The tracking antenna system of claim 1, wherein the first feed is disposed in front of the reflector adjacent the primary focal point.

5. The tracking antenna system of claim 1, wherein the first feed is affixed with respect to the reflector and the stabilized antenna support.

6. The tracking antenna system of claim 1, wherein the first feed and the second feed are affixed with respect to the reflector and the stabilized antenna support.

7. The tracking antenna system of claim 1, wherein the second feed is affixed with respect to the reflector and the stabilized antenna support.

8. The tracking antenna system of claim 1, wherein the second feed is disposed outside of the first RF path.

9. The tracking antenna system of claim 1, wherein the first of the discrete RF spectrums is a C band.

10. The tracking antenna system of claim 1, wherein the second of the discrete RF spectrums is a Ku band.

11. The tracking antenna system of claim 1, wherein the actuator includes a rotation mechanism including first and second mechanical stops and first and second limit switches to locate the position of the sub-reflector in the respective first and second positions.

12. The tracking antenna system of claim 1, wherein the first feed is operably connected to a first RF module and the second feed is operably connected to a second RF module, each of the first and second RF modules being configured for use with a first Media Exchange Points (MXP) connected to a digital antenna control unit (DAC).

* * * * *